US006143103A

United States Patent [19]

Ryder

[11] Patent Number: 6,143,103

[45] Date of Patent: Nov. 7, 2000

[54] GAS GENERATING MATERIAL FOR VEHICLE OCCUPANT PROTECTION DEVICE

[75] Inventor: David D. Ryder, Sparks, Nev.

[73] Assignee: TRW Inc., Lyndhurst, Ohio

[21] Appl. No.: 09/013,579

[22] Filed: Jan. 27, 1998

[51] Int. Cl.[7] ..... C06B 45/10; C06B 31/28; B60R 21/28

[52] U.S. Cl. ..... 149/46; 149/19.4; 149/9.6; 280/740; 280/741

[58] Field of Search ..... 149/19.4, 19.6, 149/46

[56] References Cited

U.S. PATENT DOCUMENTS

| | | | |
|---|---|---|---|
| 5,076,868 | 12/1991 | Doll et al. | 149/19.4 |
| 5,092,945 | 3/1992 | Reed, Jr. et al. | 149/19.4 |
| 5,359,012 | 10/1994 | Ampleman | 523/403 |
| 5,498,303 | 3/1996 | Hindshaw et al. | 149/19.6 |
| 5,500,061 | 3/1996 | Warren et al. | 149/19.4 |
| 5,507,891 | 4/1996 | Zeigler | 149/19.6 |
| 5,551,725 | 9/1996 | Ludwig | 102/531 X |
| 5,583,315 | 12/1996 | Fleming | 149/19.4 |
| 5,589,661 | 12/1996 | Menke et al. | 149/19.4 |
| 5,616,883 | 4/1997 | Hamilton et al. | 102/288 |
| 5,639,117 | 6/1997 | Mandey et al. | 102/530 X |
| 5,681,904 | 10/1997 | Manzara | 525/404 |
| 5,847,311 | 12/1998 | Ryder | 102/289 X |

*Primary Examiner*—Charles T. Jordan
*Assistant Examiner*—Glenda L. Sanchez
*Attorney, Agent, or Firm*—Tarolli, Sundheim, Covell, Tummino & Szabo L.L.P.

[57] ABSTRACT

A body of gas generating material for a vehicle occupant protection device comprises about 40 to about 85 weight percent ammonium nitrate. The body of gas generating material also comprises an amount of a glycidyl azide polymer (GAP). The GAP is cured with a polyfunctional acrylate. The acrylate cured GAP can be used as a binder in the gas generating composition or as an energetic coating on tablets prepared from the composition. The acrylate cured GAP can also function as the sole fuel component in the gas generating composition, the composition being essentially free of an added fuel component. The acrylate cured GAP improves the burn and/or ignition rates of the ammonium nitrate based gas generating composition.

16 Claims, 2 Drawing Sheets

GAS GENERATING MATERIAL FOR VEHICLE OCCUPANT PROTECTION DEVICE

FIELD OF THE INVENTION

The present invention relates to a body of gas generating material which is ammonium nitrate based. The body of gas generating material is particularly useful for inflating a vehicle occupant protection device.

BACKGROUND OF THE INVENTION

An inflator for inflating a vehicle occupant protection device, such as an air bag, contains a body of ignitable gas generating material. The inflator further includes an igniter. The igniter is actuated so as to ignite the body of gas generating material when the vehicle experiences a condition, such as a sudden deceleration, which is indicative of a collision for which inflation of the air bag is desired. As the body of gas generating material burns, it generates a volume of inflation gas. The inflation gas is directed into the vehicle air bag to inflate the air bag. When the air bag is inflated, it expands into the vehicle occupant compartment and helps to protect the vehicle occupant.

The body of gas generating material comprises a gas generating composition. One useful oxidizer for gas generating compositions for a vehicle occupant protection device is ammonium nitrate. Gas generating compositions comprising an energetic fuel and ammonium nitrate as the oxidizer can provide a clean, smokeless burn. However, such compositions generally have poor ignition properties and a low burn rate. To achieve higher ignition and burn rates, the inflator has to be operated at a high pressure and has to use a body of gas generating material having a large surface area, such as is provided by a large quantity of small tablets.

SUMMARY OF THE INVENTION

The present invention resides in a body of gas generating material for a vehicle occupant protection device. The body of gas generating material comprises about 40 to about 85 weight percent ammonium nitrate. The body of gas generating material also comprises an amount of a glycidyl azide polymer (GAP). The GAP is cured with a polyfunctional acrylate. The acrylate cured GAP can be used as a binder in the gas generating material or as an energetic coating on tablets prepared from the composition.

The amount of acrylate cured GAP in the body of gas generating material is that amount effective to increase the ignition and/or burn rates of the gas generating material.

Preferred amounts are in the range of about 2 to about 20 weight percent of acrylate cured GAP based on the weight of the body of gas generating material.

Preferred polyfunctional acrylates are selected from the group consisting of pentaerythritol triacrylate (PE3A), pentaerythritol diacrylate (PE2A), hexanediol diacrylate (HDDA), hexanediol dipropiolate (HDDP), tetraethylene glycol diacrylate (TEGDA), and polyethylene glycol diacrylate (PEGDA).

A preferred ratio of polyfunctional acrylate to GAP in the acrylate cured GAP is in the range of about 5 to about 100 parts by weight of acrylate to 100 parts by weight of GAP.

In one embodiment of the present invention, the body of the acrylate cured GAP functions as the sole fuel component in the gas generating composition as well as a binder.

In another embodiment of the present invention the gas generating composition comprises a fuel component in addition to the acrylate cured GAP. A preferred fuel component is a non-azide organic fuel.

BRIEF DESCRIPTION OF THE DRAWINGS

The present invention and advantages thereof will become more apparent from the following description with reference to the accompanying drawings, in which.

DETAILED DESCRIPTION OF THE INVENTION

Figure 1:
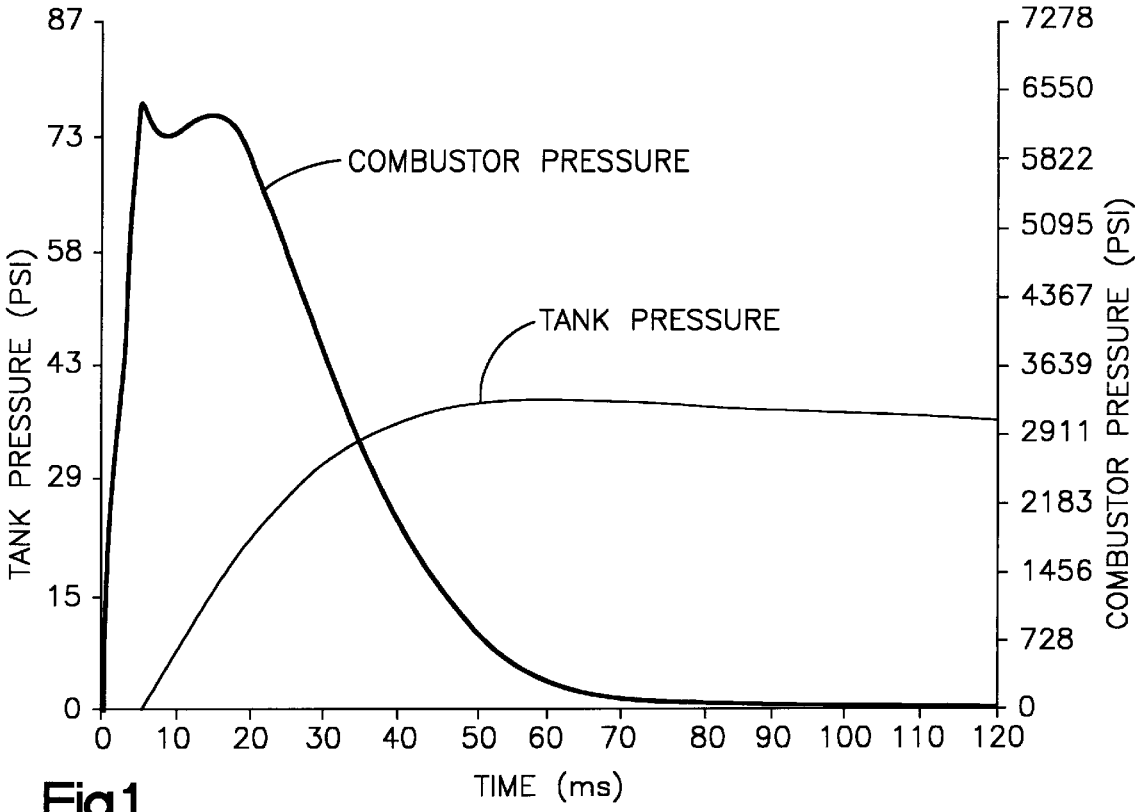
FIG. 1 is a computer generated graph showing the rate of increase in inflator pressure resulting from combustion of a body of gas generating material having a gas generating composition in accordance with one embodiment of the present invention.

The body of gas generating material of the present invention is an ammonium nitrate based gas generating composition. The gas generating composition comprises about 40 to about 85 weight percent of ammonium nitrate, based on the weight of the gas generating material, preferably about 50 to about 80 weight percent.

The ammonium nitrate can be phase-stabilized, but it is a feature of the present invention that the ammonium nitrate need not be phase-stabilized. The phase stabilization of ammonium nitrate is well known.

Preferably, the ammonium nitrate is ground into two fractions, one being a coarse fraction, for instance having an average particle size of about 80 to about 600 microns, the other being a fine fraction, for instance, having an average particle size of about 10 to about 40 microns. The amount of the coarse fraction in the gas generating composition is preferably in the range of about 25 to about 60 weight percent, based on the weight of the gas generating composition, and the amount of the fine fraction in the composition is preferably about 15 to about 30 weight percent, also based on the weight of the gas generating composition.

A critical component of the gas generating composition of the present invention is an acrylate cured glycidyl azide polymer (GAP). GAP traditionally is prepared by polymerizing epichlorohydrin to poly(epichlorohydrin) and then reacting the polymer with sodium azide in the presence of dimethylsulfoxide. The GAP polymer is frequently represented by the structural formula:

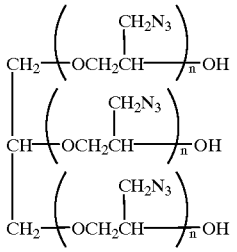

n = 20–45

GAP

Traditionally, GAP is cured with a polyisocyanate. The polyisocyanate cured GAP is a relatively non-energetic material. Ammonium nitrate based gas generating compositions employing polyisocyanate cured GAP as a binder or fuel generally have, as a result, poor ignition properties and low burn rates, typically less than about 0.1 inch per second at 1,000 psi, e.g., 0.06 to 0.08 inch per second.

In the present invention, the glycidyl azide polymer (GAP) is reacted or cured with a polyfunctional acrylate, such as a diacrylate or triacrylate. The reaction may be a cross-linking or curing reaction in which the azido group (—$RN_3$) of the GAP polymer reacts with the double bond of the acrylate to form a triazole or triazoline in accordance with the following reaction:

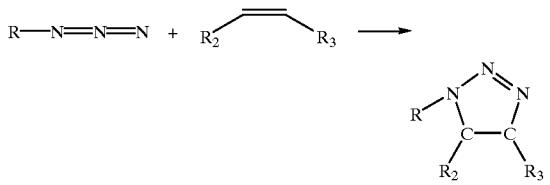

Cross-linking may take place according to the following reaction:

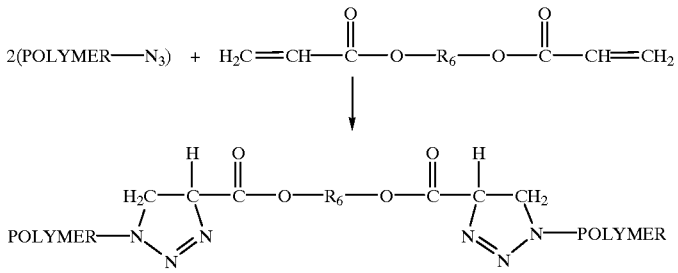

The N═N bonds in the heterocyclic rings of the acrylate cured GAP are relatively weak, thus making the acrylate cured GAP a more energetic material than isocyanate cured GAP. At the same time, by varying the proportions and composition of ingredients, the desired physical and mechanical properties available with a cured GAP can be obtained.

Useful polyacrylates in the above reaction include pentaerythritol triacrylate (PE3A), pentaerythritol diacrylate (PE2A), hexanediol diacrylate (HDDA), hexanediol dipropiolate (HDDP), tetraethylene glycol diacrylate (TEGDA), and polyethylene glycol diacrylate (PEGDA).

The glycidyl azide polymer (GAP) in the above reaction can be a GAP polyol or a GAP diol, both having hydroxyl functionality. However, since hydroxyl groups are not involved in the cross-linking or curing reaction, GAP plasticizer having no hydroxyl functionality can also be used. Similarly, the GAP can also be an isocyanate cured glycidyl azide polymer (GAP) wherein additional cross-linking occurs at the double bonds of the acrylate moieties. Good results are obtained with a GAP monomer or polymer having a molecular weight in the range of about 600 to about 7,000. Examples are a GAP polyol having a nominal molecular weight of about 5500 and a nominal functionality of about 2.7, a GAP diol having a nominal molecular weight of about 2400 and a nominal hydroxyl functionality of about 2, and a GAP plasticizer having a nominal molecular weight of about 700 with no hydroxyl functionality.

The product of the cross-linking reaction can be a soft rubbery mass or a rigid plastic depending upon the amount of polyfunctional acrylate used, its functionality, and the composition of the GAP which is used.

Broadly, the cross-linking reaction can be carried out at the ratio of about 5 to about 100 parts of acrylate to 100 parts of GAP monomer or polymer, preferably in the range of about 10 to about 25 pph (parts per hundred) of acrylate to GAP polymer.

By way of example, good results have been obtained with 20 pph of PE3A reacted with GAP polyol, giving a Shore A hardness of about 90 and a burn rate of about 0.22 ips (inches per second) at ambient pressure; HDDA reacted with GAP polyol at 20 to 100 pph giving a Shore A hardness in the range of about 79 to 99.5 and sustained burning at ambient pressure; HDDP reacted with GAP polyol at 50 to 100 pph giving a Shore A hardness in the range of about 95 to 100 and a burn rate of about 0.4 to about 0.8 ips at ambient pressure; PE3A with GAP diol at 20 to 50 pph giving a Shore A hardness in the range of about 86 to 100 and sustained burning at ambient pressure; and HDDA with GAP diol at about 50 pph giving a Shore A hardness of 89 and sustained burning at ambient pressure. An isocyanate cured GAP is incapable of sustained burning at atmospheric pressure.

The acrylate cured GAP can be used as primarily a binder in the body of gas generating material, or as an energetic coating for the body of gas generating material. It can also be used as the sole fuel component in the body of gas generating material as well as functioning as a binder, the gas generating composition being essentially free of an added fuel component.

When the acrylate cured GAP is used as a binder in the body of gas generating material, the cross-linking reaction between the GAP polymer and polyacrylate can occur in-situ following mixing of all of the ingredients of the gas generating composition, and during or after forming the composition into a desired configuration (e.g., the body of gas generating material) for use in an inflator. The cross-linking reaction is temperature dependent and can take place at ambient temperature over several days or can be facilitated by the application of heat, e.g., 30 minutes at 60° to 90° C.

By way of example, the ingredients of the gas generating composition, including the GAP polymer and acrylate added individually, can be blended together using conventional blending techniques, and then the blend can be extruded, and the extrudate cut into a desired configuration, for instance, small cylinders, in a continuous process. The extrusion can be at a temperature which is above room temperature so that cross-linking starts to occur during the extrusion step and is completed after leaving the extruder using a heating tunnel.

As an alternative, the gas generating composition can be formed into a desired configuration, for instance tablets, by compaction in a die. In this process, the ingredients of the composition can be blended together, and then the blend can be compacted into the configuration which is desired. Heat can be applied to the composition during the compaction step to at least start cross-linking during compaction. As an alternative, cross-linking can occur after compaction, for instance in a heating tunnel.

In the process of forming tablets, it may be desirable first to blend ingredients of the gas generating composition, except for the GAP and acrylate. Then apply the GAP and acrylate, premixed with a solvent, as a spray or flow coating to particles of the other ingredients. Thereafter, dry and compact the particles. In this process, as well as the above processes, the acrylate cured GAP functions as a binder to hold the particles together.

When the acrylate cured GAP is used as an energetic coating only for the tablets (not particles), and not as a binder, the gas generating composition without acrylate cured GAP is first formed into a body of gas generating material, for instance by extrusion or compaction. A premix of the polyacrylate and GAP can then be prepared, and the premix is applied to the body of gas generating material using conventional coating techniques. Curing can take place before or after coating, either at ambient temperature or with the application of heat.

The amount of acrylate cured GAP in the body of gas generating material is dependent upon the function or functions of the acrylate cured GAP in the body. Broadly, the amount is in the range of about 2% to about 20% based on the weight of the body of gas generating material.

In all instances, the acrylate cured GAP functions in the present invention to increase the ignition and/or burn rates. When employed as a coating, the acrylate cured GAP functions primarily to enhance ignition of the body of gas generating material. At least about 2%, based on the weight of the body of gas generating material, is necessary for this function. When used in the composition as a binder, the amount is a binding amount. This may be the same or more than that effective to enhance the ignition and/or burn rates.

In the compaction process wherein particles of the ingredients are spray or flow coated with a solution or suspension of GAP and acrylate, and the acrylate cured GAP functions as a binder for the particles following compaction, about 3% by weight of the GAP and acrylate preferably is used.

In the extrusion process, wherein the GAP functions as an extrusion aid as well as binder, less than about 15% by weight of the GAP and acrylate preferably is used, preferably in the range of about 5% to about 15% by weight.

In gas generating compositions wherein the GAP and acrylate function as the fuel component for the composition as well as the binder, about 10% to about 15% by weight of acrylate cured GAP preferably is used.

The gas generating composition of the present invention can comprise other ingredients in addition to the ammonium nitrate and the acrylate cured GAP. For instance, the gas generating composition can comprise a fuel in addition to the acrylate cured GAP. Preferred fuels, in this invention, are organic fuels which are not azides. Examples are organic nitrates or nitro-organics such as guanidine nitrate (GN), triamino guanidine nitrate (TAGN), tetramethyl ammonium nitrate, hexahydro-1,3,5-trinitro-1,3,5 triazine (RDX), octahydro-1,3,5,7-tetranitro-1,3,5,7-tetrazine (HMX), and nitrocellulose; azoles including triazoles and tetrazoles and salts thereof such as 5-aminotetrazole (SAT) and 3-nitro-1,2,4-triazole-5-one (NTO); guanidine derivatives such as nitro guanidine (NQ); oxamide; urea and urea salts; and other organic salts such as guanidine perchlorate or guanidine picrate. Preferably, the fuels contain one or more oxygen atoms in the fuel molecule. The amount of fuel in the gas generating composition can be in the range of zero to about 45%, preferably in the range of about 10% to about 45%, based on the weight of the gas generating composition.

The composition of the present invention can also comprise: other oxidants such as potassium perchlorate, ammonium perchlorate, potassium nitrate, copper chromite, and ammonium dichromate; a burn rate catalyst such as carbon black; stabilizers such as Protech 8725 marketed by Mach 1, diphenylamine; and other materials conventionally used in gas generating compositions for vehicle occupant protection devices.

The following Examples illustrate the present invention.

EXAMPLE 1

This Example illustrates the use of the acrylate cured GAP as a fuel-binder in the gas generating composition of the present invention.

The following gas generating composition was prepared using a conventional mixer.

| Ingredient | Weight Percent |
|---|---|
| Ammonium nitrate (coarse*) | 55.05 |
| Ammonium nitrate (fine**) | 23.66 |
| Potassium perchlorate (coarse*) | 5 |
| GAP plasticizer | 13.18 |
| Pentaerythritol triacrylate | 1.97 |
| N-methyl-4-nitroaniline (stabilizer) | 0.05 |
| 1,8-bis-dimethylamino naphthalene (stabilizer) | 0.05 |
| Pro-tech 8725 (stabilizer) | 0.1 |
| HX-878 (amine bonding agent) | 0.44 |
| Thermax N-991 (carbon black) | 0.5 |

*Screened through 425 micron screen
**Screened through 63 micron screen

The composition was extruded into a body of gas generating material having a generally tubular configuration and a diameter of about 25 mm. The outside surface was provided with an array of six equally spaced longitudinally extending radially directed outer slots having a depth of about 2.5 mm. The inside comprised a longitudinally extending axial opening about 12 mm in diameter which was also provided with an array of six equally spaced longitudinally extending radially directed slots (depth 2.5 mm). Following extrusion, the body was cut into unit lengths of about 35 mms. Curing occurred during extrusion and subsequent heating for about 30 minutes at 60° C.

A single unit having a weight of about 20 grams was tested in a conventional ballistic test motor having a 60 liter tank. FIG. 1 gives the tank and combustor pressures that were obtained. The tank reached an average peak pressure, in five shots, of about 39.5 psi at about 57 ms (milliseconds). The time to 1% of peak was 5.4 ms, and to 95% of peak, about 44 ms. The area under the tank pressure curve from 5% of peak to 95% of peak was about 930 to 980 ms.psi. The slope at 5 ms was about 12, and at 10 ms, about 10. The burn rate in inches per second at 1,000 psi was 0.22 to 0.26 with a pressure exponent in the range of 0.6 to 0.8. The results illustrated in FIG. 1 are significantly better than those obtainable using a conventional isocyanate cured GAP binder system. The composition had good high temperature mechanical stability. The composition free of an added fuel component permits the use of lighter weight vehicle occupant protection device hardware.

EXAMPLE 2

This Example illustrates the use of the acrylate cured GAP primarily as a binder component in the gas generating composition. The composition also comprises a non-azide organic fuel.

The following gas generating composition was prepared using a conventional V-blender.

| Ingredient | Weight Percent |
|---|---|
| Ammonium Nitrate (90–100 $\mu$) | 47.1 |
| Ammonium Nitrate (12–15 $\mu$) | 25.4 |
| Potassium Perchlorate (45 $\mu$) | 5 |
| GAP Plasticizer | 7 |
| Pentaerythritol Triacrylate | 1 |
| Nitroguanidine (fuel) | 14 |
| Carbon Black | 0.5 |

The composition following mixing was compacted into aspirin-shaped domed tablets having a diameter of about 4.76 millimeters and a height in the range of about 3.5 to 3.8 millimeters. The GAP was cured by the polyacrylate by heating the tablets at 90° for 30 minutes.

Figure 2:
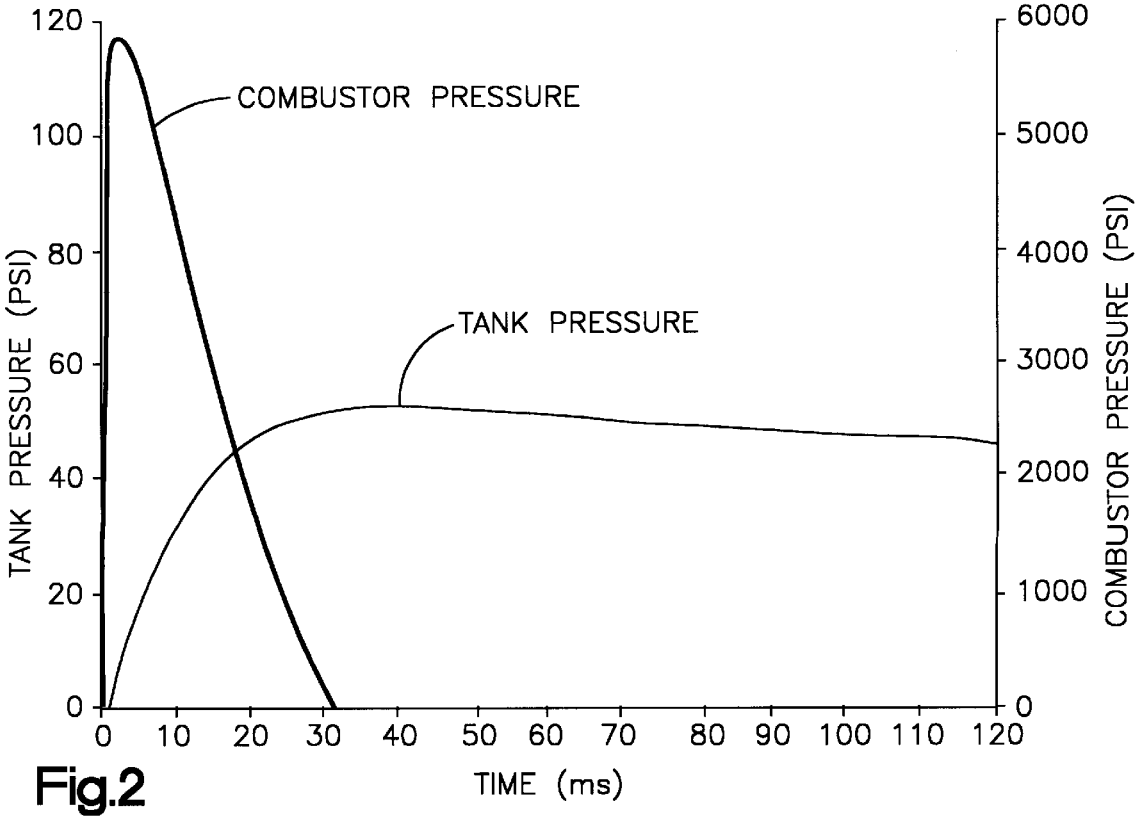
FIG. 2 is a computer generated graph showing the rate of increase in inflator pressure resulting from combustion of a body of gas generating material having a gas generating composition in accordance with a second embodiment of the present invention.

The tablets, in the amount of about 20 grams, were tested in a ballistic test motor as in Example 1. The test motor had about a 28 liter tank (one cubic foot). FIG. 2 gives the tank pressure and combustor pressure in psi. The tank reached a peak pressure of 53.6 psi at 37.2 ms. The time to 1% of peak was 0.9 ms and to 95% of peak, 27.2 ms. The area under the tank pressure curve from 5% of peak to 95% of peak was 869.2 ms. psi. The slope at 5 ms was 3.3 and at 10 ms, 3.1. The tablets had a burn rate of about 0.22 to about 0.24 inches per second at 1,000 psi, with a pressure exponent of about 0.8.

The results illustrated in this Example are significantly better than those obtained using an ammonium nitrate based propellant comprising an energetic fuel and a conventional binder system, in terms of burn rate, and ignition properties. The composition had good high temperature mechanical stability. The improved burn rate allows inflator operation at lower pressures and temperatures.

EXAMPLE 3

This Example illustrates the use of acrylate cured GAP as a coating for a body of gas generating material using the gas generating composition of the present invention.

The following gas generating composition was prepared using a conventional V-blender.

| Ingredient | Wt. Percent |
|---|---|
| Ammonium Nitrate (90–100 $\mu$) | 27.69 |
| Ammonium Nitrate (12–15 $\mu$) | 28 |
| Nitroguanidine | 38.81 |
| Cab-O-Sil (Fumed Silica Flow Aid) | 0.5 |
| Potassium Perchlorate | 5 |

The blend was pressed into tablets as in Example 1, and the tablets were coated with a coating mixture comprising, based on the weight of the body of gas generating material (including coating), about 5% GAP containing 13% PE3A (based on the weight of GAP).

Figure 3:
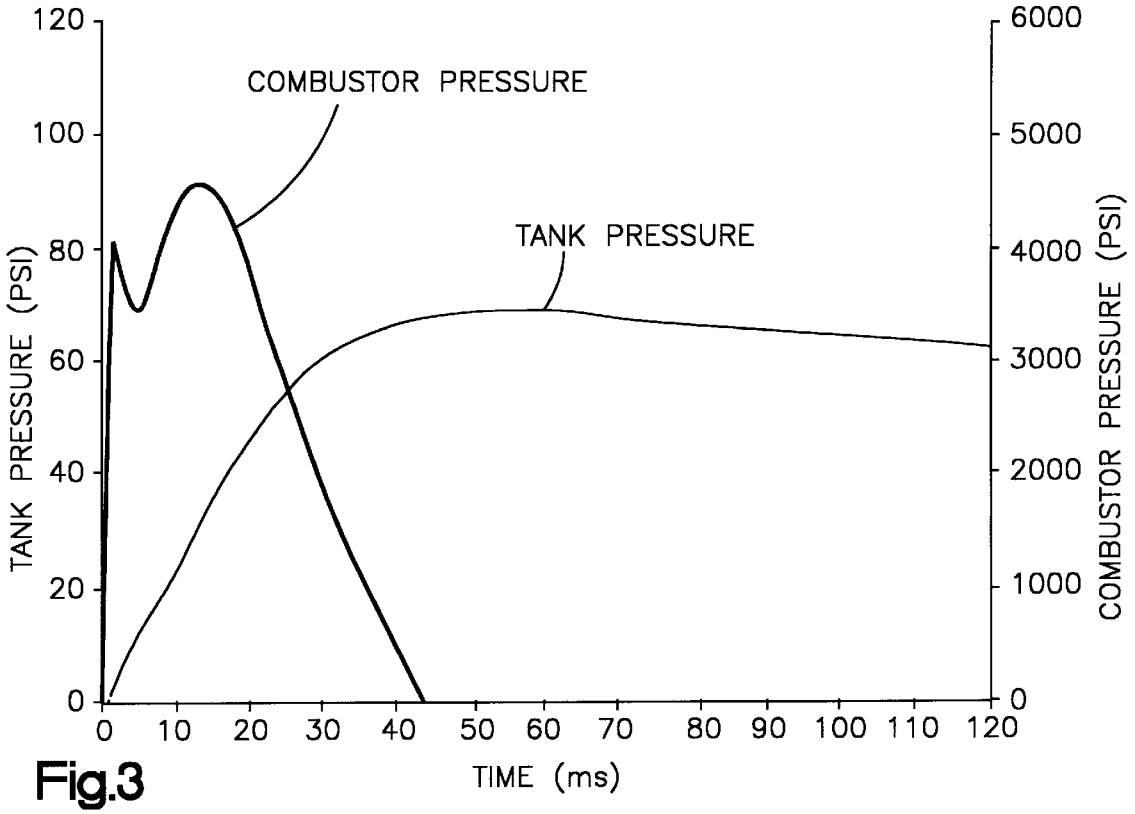
FIG. 3 is a computer-generated graph showing the rate of increase in inflator pressure resulting from combustion of a body of gas generating material in accordance with a still further embodiment of the present invention.

The coated tablets, in the amount of about 20 grams, were placed in the combustion chamber of a ballistic test motor having a tank volume of about 28 liters (one cubic foot) and fired. The results of the tests are shown in FIG. 3. The tank had a peak pressure of 68.5 psi at 54.5 ms. The time to 1% of peak was 1.2 ms and to 95% of peak, 40.1 ms. The area under the tank pressure curve from 5 to 95% of peak was 1538.4 psi. ms. The slope at 5 ms was 2.4, and at 10 ms (max) 2.3.

The gas generating composition coated with acrylate cured GAP showed improved ignition properties. The same formulation without acrylate cured GAP failed to sustain combustion when ignited.

Similar results are obtained with tablets coated with acrylate cured GAP down to about 2.5 weight % based on the weight of the body of gas generating material.

From the above description of the invention, those skilled in the art will perceive improvements, changes and modifications. Such improvements, changes and modifications within the skill of the art are intended to be covered by the appended claims.

Having described the invention, the following is claimed:

1. A body of gas generating material for a vehicle occupant protection device comprising:

(a) about 40 to about 85 weight percent ammonium nitrate; and (b) a polyfunctional acrylate cured glycidyl azide polymer (GAP), wherein the amount of polyfunctional acrylate cured glycidyl azide polymer (GAP) is that amount effective to increase the ignition and/or burn rates of said body of gas generating material.

2. The body of claim 1 wherein said polymer is a binder in said body of gas generating material.

3. The body of claim 1 wherein said polymer is a coating on said body of gas generating material.

4. The body of claim 1 wherein said amount is about 2 to about 20 weight percent based on the weight of the body of gas generating material.

5. The body of claim 1 wherein said polymer is GAP plasticizer cured with a polyfunctional acrylate.

6. The body of claim 1 wherein said polyfunctional acrylate cured glycidyl azide polymer (GAP) is a polyol or diol.

7. The body of claim 5 wherein said acrylate is a diacrylate or triacrylate.

8. The body of claim 1 wherein said acrylate is selected from the group consisting of pentaerythritol triacrylate (PE3A), pentaerythritol diacrylate (PE2A), hexanediol diacrylate (HDDA), hexanediol dipropiolate (HDDP), tetraethylene glycol diacrylate (TEGDA), and polyethylene glycol diacrylate (PEGDA).

9. The body of claim 1 wherein the polyfunctional acrylate cured glycidyl azide polymer (GAP) is the reaction product of a polyfunctional acrylate and GAP, and the ratio of acrylate to GAP is in the range of about 5 to about 100 pph.

10. The body of claim 1 further including a non-azide fuel.

11. The body of claim 10 wherein said non-azide fuel is selected from the group consisting of an organic nitrate, a nitro-organic, a triazole, a tetrazole, a guanidine or a guanidine derivative, oxamide, urea, and salts thereof.

12. An inflator for inflating a vehicle occupant protection device comprising the body of gas generating material of claim 1.

13. A body of gas generating material for a vehicle occupant protection device comprising:

(a) about 40 to about 80 weight percent ammonium nitrate, and (b) a cured glycidyl azide polymer (GAP) comprising a side chain having a heterocyclic triazoline ring, wherein the amount of cured glycidyl azide polymer (GAP) is that amount effective to increase the ignition and burn rates of said body of gas generating material.

14. A vehicle occupant protection device comprising a body of gas generating material, said body comprising:

(a) about 40 to about 85 weight % ammonium nitrate;

(b) about 2 to about 20 weight % acrylate cured glycidyl azide polymer; and (c) zero to about 45 weight % of a non-azide organic fuel;

wherein said acrylate cured glycidyl azide polymer is a binder or coating in said body.

15. A vehicle occupant protection device comprising an ammonium nitrate based gas generating composition, said composition comprising:

(a) about 40 to about 85 weight % ammonium nitrate; and (b) about 2 to about 20 weight % acrylate cured glycidyl azide polymer;

wherein said composition is essentially free of an added fuel.

16. A vehicle occupant protection device comprising a body of gas generating material, said body comprising:

(a) about 40 to about 85 weight % ammonium nitrate; and (b) about 2 to about 20 weight % of a cross-linked GAP polymer in which the cross-link comprises 1,2,3-triazole groups.

* * * * *